United States Patent [19]

Hayashi et al.

[11] 4,077,458

[45] Mar. 7, 1978

[54] CORE AND METHOD FOR CASTING CYLINDER HEAD WITH EXHAUST PORT

[75] Inventors: Yoshimasa Hayashi; Kunio Sensui, both of Yokohama, Japan

[73] Assignee: Nissan Motor Company, Limited, Japan

[21] Appl. No.: 712,091

[22] Filed: Aug. 5, 1976

[30] Foreign Application Priority Data

Aug. 8, 1975 Japan ..... 50-110367[U]
Aug. 15, 1975 Japan ..... 50-112929[U]

[51] Int. Cl.[2] ..... B22D 19/00; B22D 25/00; B22C 9/10

[52] U.S. Cl. ..... 164/11; 60/282; 164/9; 164/369

[58] Field of Search ..... 164/9, 10, 11, 98, 369; 60/282

[56] References Cited

U.S. PATENT DOCUMENTS

| | | | |
|---|---|---|---|
| 1,170,180 | 2/1916 | O'Dowd | 164/9 |
| 2,065,287 | 12/1936 | Nutt | 164/369 X |
| 3,868,990 | 3/1975 | Grawey | 164/369 |
| 3,994,270 | 11/1976 | Nakano et al. | 60/282 X |
| 4,031,699 | 6/1977 | Suga et al. | 60/282 |

*Primary Examiner*—Robert D. Baldwin
*Attorney, Agent, or Firm*—Robert E. Burns; Emmanuel J. Lobato; Bruce L. Adams

[57] ABSTRACT

A segmented port liner is disposed about a precured inner casting core. Pre-cured casting cores are fixed onto the surface of the liner. If desired, another segmented liner may be disposed thereabout and similarly covered with the pre-cured casting cores. The above combination serves an exhaust passage casting core.

9 Claims, 11 Drawing Figures

CORE AND METHOD FOR CASTING CYLINDER HEAD WITH EXHAUST PORT

BACKGROUND OF THE INVENTION

The present invention relates in general to an internal combustion engine which is constructed to produce a minimum amount of harmful compounds, and particularly to a cylinder head, for an engine, having port liners within the exhaust port passages. More specifically, the present invention is concerned with an improved cylinder head and a method of forming exhaust port passages in a body of the cylinder head, the exhaust port passages receiving therein port liners for obtaining preferable thermal insulation between the exhaust gases passing therethrough and the body of the cylinder head.

For the purpose of reducing harmful compounds, such as hydrocarbons (HC) and carbon monoxide (CO), contained in the exhaust gases emitted from the internal combustion engine, after combustion devices such as a thermal reactor and a catalytic converter are employed in the exhaust system of the engine. In the case of a thermal reactor, the oxidizing efficiency is critically dependent upon the temperature of the exhaust gases being admitted into the device, and thus, it is necessary to minimize the heat loss in the exhaust system to keep the exhaust gases at the highest possible temperature.

Conventional internal combustion engine systems have thus, port liners within the exhaust port passages formed in a monocast cylinder head and, more sophisticatedly, have an insulating space or clearance formed around the port liner for thereby obtaining more effective thermal insulation between the exhaust gases passing through the exhaust port passages and the body of the cylinder head.

In connection with the method of disposing such port liners in the exhaust port passages of the cylinder head and of forming such insulating space or clearance around the port liners in the cylinder head, it has been proposed that, the cylinder head be formed by casting, and each port liner member filled with so called moulding sand and covered by a shaped casting core or cores made of moulding sand is placed in its proper place in the casting box for the cylinder head. After the casting, the moulding sand received in and on the port liner is removed through the outlet of the port liner and holes, which holes are arranged in the vicinity of the outlet of the exhaust port passage in the cast cylinder head. With this sand removing operation, the port liner is left in the exhaust port passage and simultaneously, the heat insulating space is formed.

In this conventional method, however, there is a problem that if the port liner has a complicated curvature due to the complicated construction of the exhaust port passage, the curing operation of the moulding sand received in the port liner must be done after the moulding sand is filled into the port liner, in other words, the heating operation for the moulding sand to cure the same is inevitably carried out when the moulding sand is packed in the port liner. Thus, it takes a long time to completely or preferably cure the moulding sand because of the heat insulating action of the port liner. In reality, it has been often observed that the casting core sand nearest the port liner is subjected to over-cure when the moulding sand near the center of the port liner is preferably cured. Furthermore, if the port liner is preheated to about 300° C for the purpose of shortening the curing time of the moulding sand therein, some specially designed machines are required to protect the worker from dangerous heat radiating from the heated port liner.

SUMMARY OF THE INVENTION

Thus, the present invention is proposed to solve the above-mentioned problems of the conventional method and to provide an improved method by which production of a cylinder head with a port liner is earier and faster.

It is an object of the present invention to provide a simple method of installing a port liner in an exhaust port passage of a cylinder head.

It is another object of the present invention to provide an improved method of preparing a core structure for the formation of an exhaust port passage of a cylinder head upon casting of the cylinder head.

It is still another object of the present invention to provide an improved core structure which includes a longitudinally dividable port liner and an inner casting core received in the segmented port liner, the inner casting core being preferably cured before being set in the segmented port liner.

It is a further object of the present invention to provide a cylinder head for an internal combustion engine, comprising a body having an exhaust port passage and an interior surface defining the exhaust port passage, a port liner made of metal and longitudinally disposed in the exhaust port passage so as to be spaced apart from the interior surface, the port liner being divided into of at least two semi-cylindrical metal segments (which form a generally tubular structure when put together), the port liner being assembled with the body via the following steps:

(a) preparing an inner cured shaped casting core made of moulding sand,
(b) covering the inner cured casting core with the semi-cylindrical metal segments,
(c) seaming the contacting edges of the semicylindrical metal segments to form the generally tubular structure receiving therein the cured inner casting core, and
(d) using the seamed semi-cylindrical metal segments with the cured inner casting core as a core for the formation of the exhaust port passage upon casting operation of the cylinder head.

BRIEF DESCRIPTION OF THE DRAWINGS

Other objects and advantages of the present invention will become more apparent from the following detailed description when taken in conjunction with the accompanying drawings, in which.

DESCRIPTION OF THE PREFERRED EMBODIMENTS

In order to clearly explain the present invention, a description of an exemplary prior art cylinder head will be given with reference to FIGS. 1 to 3.

Figure 1:
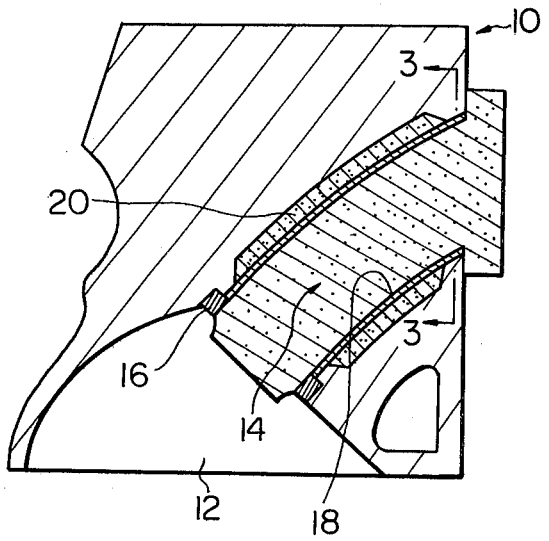
Fig. 1 PRIOR ART
FIG. 1 is a sectional view of a cylinder head showing a conventional core structure for the formation of an exhaust port passage.
Figure 2:
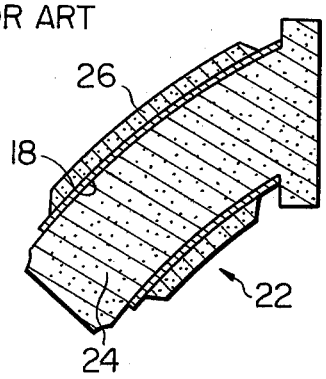
Fig. 2 PRIOR ART
FIG. 2 is a sectional view of a conventional core structure.

In FIG. 1, there is illustrated a conventional monoblock cast cylinder head 10 which is provided with a combustion chamber 12 and an exhaust port passage 14. The passage 14 is shown to be filled with a core structure in this drawing. A valve seat 16 for an exhaust valve (not shown) and a curved port liner 18 are placed in their proper sections as shown. A space 20 (shown containing moulding sand) is formed by an outer casting core between the outer surface of the port liner 18 and the inner wall of the body of the cylinder head 10 defining the exhaust port passage 14 and serves as a thermal insulating layer. The formation of the exhaust port passage 14 is made by a conventional core structure 22 which is shown in FIG. 2. The core structure 22 generally comprises the port liner 18, an inner casting core 24 received in the port liner 18, and an outer casting core 26 adhered to the outer surface of the port liner 18. The inner and outer casting cores 24 and 26 are made of moulding sand. The outer casting core 26 is shaped to correspond to the space 20 which is formed around the port liner 18 in the exhaust port passage 14.

Before being placed into the casting box, the moulding sand forming the inner and outer casting cores 24 and 26 must be heated for curing the same. However, in this case, if the port liner 18 has a complicated curvature as shown, the heat treatment to the moulding sand, especially to the inner casting core 24, must be made after the moulding sand is precisely set in the port liner 18, which means that the heat treatment of the inner casting core 24 must be done together with the port liner 18. This is because the inner casting core 24 can not fully enter the port liner 18 when hardened by the curing operation. Thus, as mentioned before, a considerably long time is required to cure the inner casting core 24 due to the heat insulation action of the port liner 18 covering the inner casting core 24.

Figure 3:
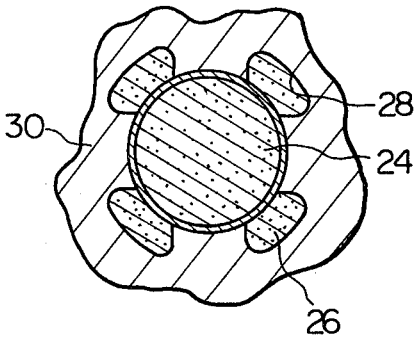
Fig. 3 PRIOR ART
FIG. 3 is a sectional view taken along the line 3—3 of FIG 1.

After the casting operation, the inner and outer casting cores 24 and 26 are smashed and then removed through an outlet (no numeral) of the port liner 18 and holes 28 located near the outlet around the port liner 18, as shown in FIG. 3. The holes 28 which are four in number in this drawing are formed to define therebetween port liner supporting portions 30 extending from the inner surface of the exhaust port passage 14 of the cylinder head 10, which means that the area of each hole 28 is limited. Thus, the removal of the outer sand lump 28 through the holes 28 is very difficult thereby lowering the production rate of the cylinder head.

Accordingly, the present invention is proposed to eliminate the above-stated drawbacks encountered in the prior art method of forming a cylinder head.

Figure 4:
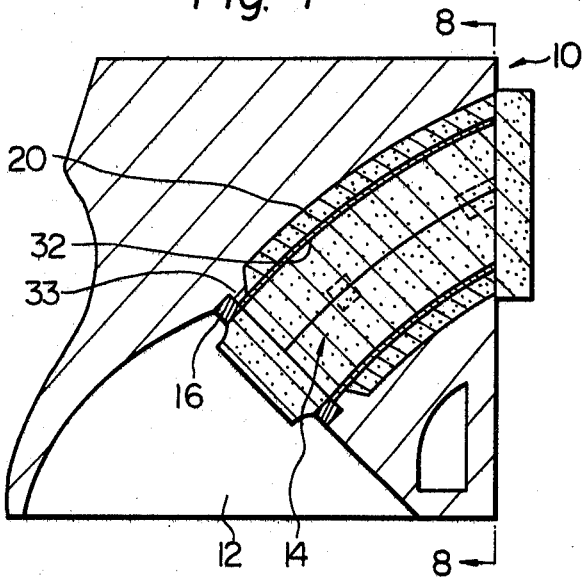
FIG. 4 is a sectional view of a cylinder head according to the present invention, this showing an exhaust port passage with an improved core structure disposed therein.

Referring now to FIG. 4 of the drawings, there is shown a monoblock cast cylinder head 10 which is in accordance with the present invention. The cylinder head 10 is illustrated to have a combustion chamber 12 and an exhaust port passage 14. The exhaust port passage 14 is shown to receive therein a core structure. A valve seat 16 for an exhaust valve (not shown) and an improved curved port liner 32 are in their proper place as shown. The inlet portion of the port liner 32 is supported by an exposed portion 33 of the port liner 32 which fuses together with the cylinder head during casting. A space 20 (also shown filled with moulding sand) is formed between the outer surface of the port liner 32 and the inner wall of the body of the cylinder head 10 defining the exhaust port passage 14 and serves as a heat insulating layer.

Figure 5:
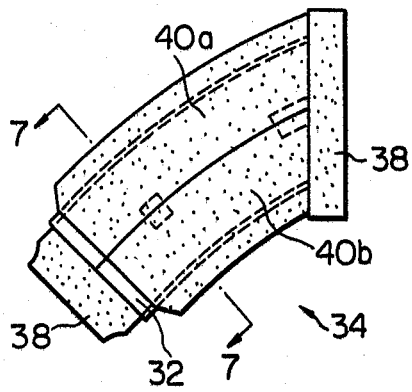
FIG. 5 is a side view of the improved core structure shown in FIG. 4.
Figure 6:
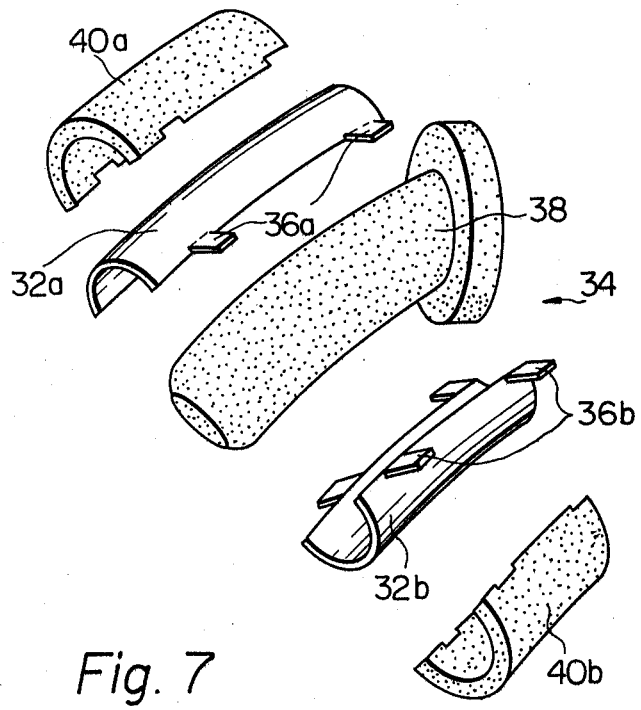
FIG. 6 is a perspective exploded view of the improved core structure.
Figure 7:
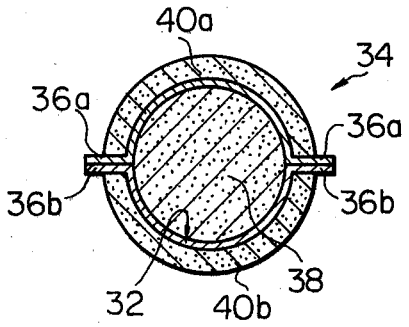
FIG. 7 is a sectional view taken along the line 7—7 of FIG. 5.

In this invention, the formation of the exhaust port passage 14 is made with an improved core structure 34 which is well shown in FIGS. 5 to 7. The improved core structure 34 comprises an improved port liner 32 which is curved and is made of a heat resisting steel place and is dividable into two semi-cylindrical segments 32*a* and 32*b* as well illustrated in FIG. 6. Preferably, the port liner 32 is dividable along an imaginary plane including in it the longitudinal axis thereof. Each of the segments 32*a* and 32*b* is provided at the base edges thereof with two pairs of projections or lugs 36*a* (36*b*), the lugs 36*a* being connected to the lugs 36*b* in suitable manner such as welding and or crimping joint, for forming the segments 32*a* and 32*b* into a single generally tubular structure. Of course, these lugs may be formed by bending the base edge portions of the semi-cylindrical segments 32*a* and 32*b*. Instead of the lugs, it is also possible to provide elongated flanges along the whole base edges of the segments 32*a* and 32*b*, though not shown in these drawings.

The reason why the longitudinally dividable port liner 32 is employed in this invention will become apparent from the following description.

After complete curing of the inner casting core 38, it is covered by the semi-cylindrical segments 32*a* and 32*b*. Then, the lugs 36*a* and 36*b* are connected to each other. If desired, the contacting base edges other than the lugs 36*a* and 36*b* may be welded for increasing the mechanical strength of the assembled port liner 32. Adhered onto the outer periphery of the assembled port liner 32 is an outer casting core 40 which is made of moulding sand and is also dividable into two semi-cylindrical sand segments 40*a* and 40*b*. The sand segments 40*a* and 40*b* are put together to be formed into a generally tubular structure capable of enveloping the assembled port liner 32. Of course, the two segments 40*a* and 40*b* must be sufficiently cured before being adhered onto the assembled port liner 32. Now, it should be noted that, as shown, in FIG. 7, the lugs 36*a* and 36*b* are sufficiently long enough to project beyond the outer casting core 40*a* and 40*b* for the reason which will be hereinlater described.

Figure 8:
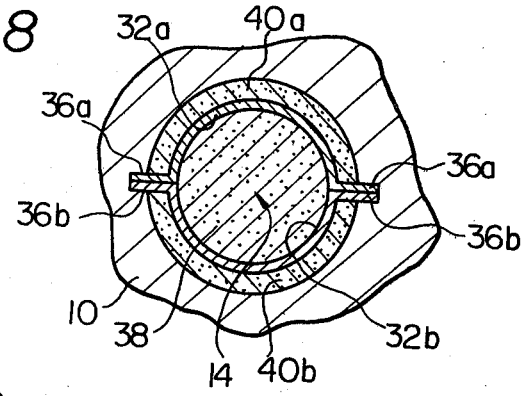
FIG. 8 is a sectional view taken along the line 8—8 of FIG. 4.

Referring again to FIG. 4, the improved core structure 34 is shown to be located in its proper position. The casting of the cylinder head 10 must be made so that the improved core structure 34 will not come loose during the casting. After the casting, the moulding sand forming the inner and outer casting cores 38 and 40 is removed from the sand filled spaces located near the outlet of the port liner 32, as well shown in FIG. 8. FIG. 8 shows a manner in which the lugs 36*a* and 36*b* of the port liner 32 are fusedly embedded in the body of the cylinder head 10 for supporting the port liner proper 32 in the exhaust port passage 14. Now, it should be appreciated that the improved core structure 34 can facilitate the sand removal from the heat insulating space 20 formed around the port liner 32 in the cylinder head 10 since the sand removing space defined between the outlet portion of the port liner 32 and the wall of the exhaust port passage 14 is not narrowed by the provision of the port liner supporting portions as in the case of conventional cylinder head mentioned before. The provision of the lugs 36*a* and 36*b* will not so greatly limit the sand removing space due to the small construction thereof. If desired, one set of lugs may be omitted from the port liner 32 to obtain a larger sand removing space in the cylinder head 10.

Figure 9:
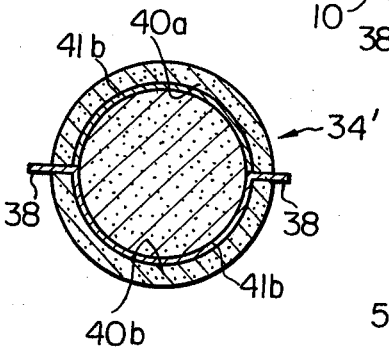
FIGS. 9 to 11 are sectional views, similar to FIG. 7, of the other improved core structures for the formation of the exhaust port passage of the cylinder head in accordance with the present invention.
Figure 10:
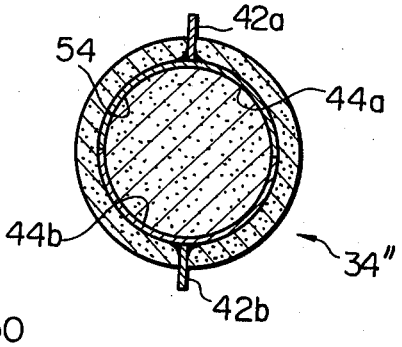

FIGS. 9 and 10 respectively show two modified core structures 34' and 34'' for the formation of the exhaust port passage 14. In FIG. 9, the lugs 38 are extended from the base portion of one semi-cylindrical segment 40*b* only. In this case, the contacting edges of the two segments 41*a* and 41*b* may be connected by welding. In FIG. 10, a pair of lugs 42*a* and 42*b* are respectively connected to two segments 44*a* and 44*b* by welding at the positions distant from the connecting interfaces of the two segments.

Figure 11:
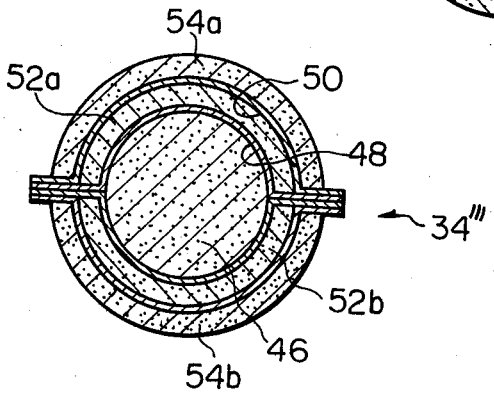

FIG. 11 shows another improved core structure 34''' which comprises an inner casting core 46, a primary port liner 48, a secondary port liner 50, a primary casting core 52*a* and 52*b*, and a secondary casting core 54*a* and 54*b*. Each of the primary and secondary port liners 48 and 50 is divided into two semi-cylindrical segments which are provided at the base edge portions thereof with lugs in the same way as the case of FIG. 8. As shown, the primary port liner 48 receiving therein the inner casting core 46 is disposed in the secondary port liner 50 so as to define between the outer periphery of the primary port liner 48 and the inner periphery of the secondary port liner 50 a generally toroidal space which receives therein the primary casting cores 52*a* and 52*b*. In this instance, the lugs of the primary port liner 48 are sandwiched between the lugs of the secondary port liner 50 as shown. Adhered onto the outer periphery of the secondary port liner 50 are the secondary casting cores 54*a* and 54*b*. Furthermore, the lugs of the primary and secondary port liners 48 and 50 are constructed to protrude a suitable distance from the outer surface of the secondary casting core 54 for the same reasons as mentioned in the case of FIG. 8. By using this core structure 34''' as a core for the exhaust port passage in the cylinder head 10 during the casting, double insulating layers are formed in the exhaust port passage 14.

From the above-stated description, it will be appreciated that, by using the improved core structures in the casting for the cylinder head, the production rate of the cylinder head having so-called port liners in the exhaust port passage is remarkably increased. More specifically speaking, since the port liner is divided into at least two segments, the inner casting core for forming the exhaust port passage proper can be heated or cured independently from the port liner before being set in the port liner. Desired curing to the inner sand lump will be thus achieved in a short time. Furthermore, the sand removal from the sand filled heat insulating spaces around the port liner in the casted cylinder head is remarkably facilitated by employment of the improved core structure of the present invention.

We claim:

1. A method of forming a cylinder head having an exhaust port passage in which a port liner is installed, comprising:

a. preparing a cured casting core made of a moulding sand;

b. covering said cured casting core circumferentially with a longitudinally segmented metal tube made as two semi-cylindrical segments thereby to form a first unit;

c. covering said first unit circumferentially with a longitudinally segmented cured casting core of lesser axial length than said metal tube end made as two semi-cylindrical sand segments made of a moulding sand thereby to form a second unit;

d. disposing said second unit in a mould;

e. casting molten metal around said second unit in said mould in the configuration of a cylinder head thereby securing the metal tube thereto; and f. removing all the core from said second unit contained in the solidified metal forming said cylinder head.

2. A method as claimed in claim 1, in which said step *b* includes:

g. pre-preparing two semi-cylindrical metal segments configured for assembly into a generally tubular structure when put together;

h. disposing the metal semi-cylindrical segments circumferentially around said cured casting core to wrap the same in said tube; and i. seaming contacting edges of said metal semi-cylindrical segments to fix the segments relative to each other.

3. A method as claimed in claim 2, in which said step c includes:

j. pre-preparing two semi-cylindrical casting cores made of moulding sand, curing said casting cores sufficiently for assembling the same together; and k. adhering said semi-cylindrical casting cores onto the outer cylindrical surface of said first unit to circumferentially cover the same.

4. A method of forming a cylinder head having an exhaust port passage in which double port liners are installed, comprising:

a. covering a cured casting core made of a moulding sand with a first longitudinally segmented metal tube provided with support means thereby to form a first unit;

b. covering said first unit with a first longitudinally segmented cured casting core made of moulding sand with said support means exposed thereby to form a second unit including the first unit;

c. covering said second unit with a second longitudinally segmented metal tube provided with support means thereby to form a third unit including said first and second units;

d. covering said third unit with a second longitudinally segmented cured casting core made of moulding sand with the support means thereof exposed thereby to form a fourth unit including said first, second and third units with the support means of said first and second tubes exposed;

e. disposing said fourth unit in a mould;

f. casting molten metal around said fourth unit in said mould in the configuration of a cylinder head thereby fixing both metal tubes thereto, and g. removing all core parts from said fourth unit contained in the solidified metal forming said cylinder head.

5. A method of forming a cylinder head having an elongated markedly curved exhaust port passage in which a port liner is installed, comprising:

a. preparing a longitudinally curved cured casting core;

b. covering said cured casting core circumferentially with a longitudinally segmented metal tube made of semi-cylindrical segments thereby to form a first unit, said metal tube being longitudinally curved to accommodate said cured casting core internally thereof and having at least one lug from each segment extending radially outwardly;

c. covering said first unit with a longitudinally segment cured casting core made of semi-cylindrical sand segments to substantially wrap the same circumferentially thereby to form a second unit, a leading end of each said lug being disposed projecting outwardly laterally from said second unit;

d. disposing said second unit in a mould;

e. casting molten metal around said second unit in said mould in the configuration of a cylinder head; and f. removing said cores from said second unit leaving each said lug contained in the solidified metal which forms said cylinder head.

6. A core unit for use in casting a cylinder head of an internal combustion engine having, an exhaust port passage with a port liner installed therein, the core unit comprising a solidified and pre-cured rigid sand unitary core made of a moulding sand, the core being curved and configured longitudinally in a configuration to correspond to an exhaust port passage in a cylinder head to be cast, a curved metal tube circumferentially intimately enclosing the sand core and corresponding longitudinally with only an axial length of the sand core therein, said tube consisting of independently pre-fabricated semi-cylindrical metal segments fixed relative to each other subsequent of enclosing of said sand core therein; means on said metal segments for fixing them together permanently defining said tube circumferentially of said sand core, a plurality of semi-cylindrical pre-cured moulding sand segments made of moulding sand adhered on said tube covering it circumferentially and extending along only a certain axial length of said tube, and said tube with said fixing means exposed constituting in use an exhaust port passage liner with a cylinder head cast thereabout embedding said fixing means therein.

7. A core unit according to claim 6, in which said sand core comprises a portion extending axially outwardly of said tube.

8. A core unit according to claim 7, in which the core portion has a greater diameter than the core within said tube.

9. A core unit according to claim 6, further including a second metal tube circumferentially intimately enclosing said sand segments, and a second plurality of semi-cylindrical pre-cured moulding sand segments made of moulding sand adhered on said second tube covering it circumferentially and extending along only a certain axial length of said second metal tube, said second metal tube comprising independently pre-fabricated semi-cylindrical metal segments fixed relative to each other subsequent to enclosing the first-mentioned sand segments therein, and means on the last-mentioned metal segments for fixing them together permanently defining said second tube.

* * * * *